US005813582A

United States Patent [19]

Wright

[11] Patent Number: 5,813,582

[45] Date of Patent: Sep. 29, 1998

[54] ADJUSTABLE SHOPPING BASKET FOR WHEELCHAIRS

[76] Inventor: Joi Henderson Wright, 4413 SE 33rd St., Amarillo, Tex. 79103

[21] Appl. No.: 783,622

[22] Filed: Jan. 14, 1997

[51] Int. Cl.[6] ..... A61G 5/10

[52] U.S. Cl. ..... 224/407; 224/550; 280/304.1; 297/188.2

[58] Field of Search ..... 224/407, 549, 224/550, 566; 280/304.1, 304.5; 297/188.18, 188.2

[56] References Cited

U.S. PATENT DOCUMENTS

| | | | |
|---|---|---|---|
| 4,158,428 | 6/1979 | Bates . | |
| 4,257,545 | 3/1981 | Rhyan . | |
| 4,339,063 | 7/1982 | Trubiano | 224/407 |
| 4,403,786 | 9/1983 | Ulics . | |
| 4,449,750 | 5/1984 | Pultman | 280/304.1 X |
| 4,484,755 | 11/1984 | Houston | 280/304.1 X |
| 4,526,419 | 7/1985 | Bowman et al. | 297/188.18 X |
| 4,659,099 | 4/1987 | Malon | 280/304.1 |
| 4,795,182 | 1/1989 | Dyess et al. | 280/304.1 |
| 4,913,393 | 4/1990 | Wood | 297/188.18 X |
| 5,294,027 | 3/1994 | Plastina | 224/407 X |
| 5,356,059 | 10/1994 | Yanez et al. | 224/407 |

*Primary Examiner*—Renee S. Luebke

[57] ABSTRACT

This basket is designed to aid the handicapped person in their daily activities which often require a way to move things from one place to another. It is collapsible and easily operated, and can be mounted, without assistance, to the armrests of a wheelchair by an occupant whose arms are still functional. This adjustable shopping basket for wheelchairs is designed to span the distance between the armrests and can be adjusted for a variety of wheelchair sizes and models. This collapsible basket has an integrally molded rectangular base housing with two sliding handle assemblies, each of which moves a support bar. Each support bar has two clamps which securely attach to each armrest. After the collapsed basket is connected to a wheelchair, it can be easily opened for use. The collapsible basket, base and sliding handle assembly are made of synthetic material. Two of the clamps are c-clamps; the other two are hinged to the support bar and are spring-loaded. Autonomous attachment and detachment of the device to a wheelchair offers independence to the user. There are no appendages to restrict a wheelchair occupant and the balance of the wheelchair is not impaired. The wheelchair can be operated within the usual space requirements while the basket is in place.

1 Claim, 9 Drawing Sheets

ADJUSTABLE SHOPPING BASKET FOR WHEELCHAIRS

BACKGROUND OF THE INVENTION

1. Field of the Invention

This invention relates generally to attachments to wheelchairs and specifically to portable, adjustable devices for assisting wheelchair users in daily living at home or away from home.

2. Description of the Prior Art

The needs of the physically challenged are numerous and widely varied depending normally on the degree and tenure of the disability. It follows then, there have been numerous and widely varied attempts to meet these needs as is evidenced by much prior art. Though many patents have been granted to cover the need wheelchair users have for a way to transport items from one place to another, the need still exists because of the many different sizes and styles of wheelchairs, both manually operated and motorized chairs. Heretofore, there is not a universal aid available.

The wheelchair, though not comfortable or pretty to look at, becomes an extension of self. Most wheelchair users are unable to walk, but even so, many of them have a very real need to be in control of their lives and to exercise some degree of independence. It is felt that the current art will greatly enhance the ability of the manually operated wheelchair user to be more in control of their daily living.

To be somewhat independent in conducting one's daily life from the seat of a wheelchair, there must still be a desire to be out and about, away from home, to attend social functions, keep appointments, go to the library, attend classes and go shopping, as well as attend to chores at home. Most of these functions would normally mean the wheelchair user would find themselves very limited to convey much of anything, because "laps" are small and arms are in constant use if the wheelchair is manually operated. I live in a wheelchair; I am a young person; I have a need and a desire to spend part of my time where there is activity and people, as opposed to looking at four walls, isolated from the world.

I realized long ago, while attending classes at a community college, I had a real need for some way to transport books, etc. to and from my car. Necessity is the mother of invention. This need became more evident as I continued to adjust to life in a wheelchair. My portable, adjustable shopping basket for wheelchairs with armrests is the answer to my needs and the needs of many others in like circumstances.

Advantages of this invention vs. the prior art will be discussed below under "Further Description of the Prior Art".

SUMMARY OF THE INVENTION

When shopping for grocery items, etc., some disabled people are able to remedy their conveyance needs with the use of mechanized wheelchairs which have baskets attached and are provided by the merchants because of legislation brought about by ADA. Said motorized wheelchairs require the user to transfer from their own wheelchairs to the motorized chairs in order to have the use of the basket. That might be good for some. This is NOT good for me! To transfer from one chair to another, IN PUBLIC, sacrifices not only my strength, but also my dignity and confidence for safety and security of my own manually operated wheelchair in my absence. To simplify and eliminate this extra required effort of using this prior art, it is felt (my) current art is the answer. The prior devices offered currently assist many persons but do not meet the needs of all disabled persons. Some handicapped people do not have the luxury of a help person, nor do they want a help person. Many of us still have a need to function independently. What I propose will adjust to fit various sized, manually operated wheelchairs with armrests; what I propose can be mounted to the wheelchair by the occupant without assistance; what I propose can be transported to and from home easily, as it is portable.

FURTHER DESCRIPTION OF THE PRIOR ART

In my research of data concerning availability of aids which would assist me in my daily living, I learned of items covered by patents already granted, but not necessarily marketed which would in some way alleviate some of the problems of daily living which are associated with being confined to a wheelchair. There is not at this point, an adjustable shopping basket for wheeichairs with armrests available to the disabled public. Those which have been invented in the past have a number of disadvantages which explains why the availability is lacking.

Previous patents issued for shopping baskets include U.S. Pat. No. 5,356,059 Basket or Tray for Attachment to Wheelchairs, by Yanez, filed 1993. Use is not simple and would be difficult to maneuver. Two of the appendages rest against the outer edge of seat of wheelchair, further confining occupant of wheelchair. This invention could not be used on my wheelchair since this design is not compatible with the vertical supports on the back of my chair because they are enclosed within fabric. I am not aware of it being manufactured and available to the public.

U.S. Pat. No. 5,294,027—Portable Combination Table Top/Basket Apparatus, by Plastina, Mar. 15, 1994 will not accommodate my chair. It also does not appear to be adjustable for different chair widths; it is not designed to accommodate anything other than very small items. Possibly this item, though patented, has not been marketed.

U.S. Pat. No. 4,795,182—Wheelchair with Pivoted Basket, by Bell & Dyess, September 1987 which just seems to be a basic wheelchair invention which happens to have a basket. It bears no similarity to current art.

U.S. Pat. No. 4,257,545—Shopping Basket for a Wheelchair, by Rhyan, March 1981. The locking arm mechanism must surely be heavy. The second point of contact for support will rest upon the flat surface of the foot plate and must have a bearing on the comfort of wheelchair occupant. Positioning the vertical support to the footrest would be inconvenient to say the least unless occupant had some assistance. Current art is autonomously portable.

U.S. Pat. No. 4,403,786—Wheelchair Shopping Basket. by Ulics, September 1983 has the main problem of location/positioning of the basket. It rests too great a distance from occupant and would pose some difficulty while filling the basket. It does appear to have concern for support of the basket, too, though it would be awkward and heavy to transport; heavy to operate wheelchair with same attached; support means are apparently heavy. Current art is light weight, non-restricting to the user, well balanced even when completely filled, and can be utilized autonomously.

U.S. Pat. No. 4,339,063—Container/Basket for Wheelchair, by Trubiano, Jul. 13, 1982 has support brackets in form of channel members which could easily damage upholstery of armrest. Apparently the transverse rod on underside of basket allows channel members to position at one point on each armrest. It appears that each point of contact with armrest is minimal and therefore weight of basket contents would pose concern that basket lacks stability since there are only two points of contact. The current art provides four points of contact by means of stationary "C" clamp on handle assembly as well as metal support bar with hinged clamp. Said metal support bar permits user to pull/move support bar along length of armrest toward body of wheelchair occupant; consequently, basket is supported and stabilized by support bar as well as armrests. The "C" clamp of the current art snaps down around armrest with one thrust and the hinged clamp is guided to connect to trailing area of armrest. Once this is accomplished, basket of current art is ready to be opened for use. Trubiano art is not available in our area if it is considered generally available to the public.

U.S. Pat. No. 4,484,755—Wheeled Cart for Use by Handicapped, Invalid and Frail Persons, by Houston, Nov. 27, 1984—Houston art is very bulky—requires greater space in which to maneuver and certainly could not be considered portable! It is even doubtful it is offered by commercial establishments to meed ADA directives and not many homes could accommodate the use of Houston art because of its size and bulk. Current art is unique in that it is autonomously portable and would be useful within a home environment as well as commercially. Not to be overlooked, is the amount of extra strength demands which would be made on manually operated wheelchair user when attempting use of Houston art.

Both Houston art and Trubiano art would encumber user to the point of creating little advantage to the user.

U.S. Pat. No. 4,158,428—Drop on Lift off Basket Assembly for a Wheelchair, by Bates June 1979—This basket connects to armrests and foot plate but appears to almost rest on thighs of occupant between armrests. The confinement of both basket in such close proximity with body, and support resting on foot plate, would surely restrict the person in chair. Current art will not restrict wheelchair user and confidence in stability and balance of same would be of no concern.

U.S. Pat. No. 4,526,419—Basket and Tray Attachment for Wheelchair, by Bowman July 1985—Method of attaching this basket makes it very undesirable. Possibly this has never been manufactured or marketed.

OBJECTS AND ADVANTAGE

Accordingly, several objects and advantages of my adjustable shopping basket for wheelchairs as described below are:

(a) My adjustable shopping basket for wheelchairs is exceedingly simple—simple to manufacture and simple to use. It's compactness and simplicity makes adjusting for wheelchair width and connecting to wheelchair armrests almost effortless. Also, my design has no appendages to cope with. The support bar cannot be totally removed.

(b) Great care has been taken in the design of current art so as to reduce/eliminate possible damage to any part of wheelchair, i.e. hinged support bar is designed so as to avert damage to top surface of armrest. Underside clamp is attached with double flat head sex screws to, once again, prevent possible damage to top surface of wheelchair armrests.

(c) Current art is universal for all makes and sizes of wheelchairs with armrests and it's use is accomplished with a simple procedure.

(d) Current art is made of (fiberglass or a like) synthetic material; i.e. aluminum, plastics—even fabric might be used for the "basket" portion; consequently, it is very light weight which is a major consideration for wheelchair occupant and wheelchair operation.

(e) There are four points of contact (to the armrests of wheelchair) which are within immediate reach and sight of wheelchair occupant. Neither the contact points nor the basket itself will restrict or confine occupant and same can be mounted autonomously. The basket itself is initially secured to forward end of armrest making the opening of the container convenient to shopper without demanding undue exertion.

(f) Balance of basket as well as wheelchair occupant is stable—occupant can reach basket easily and thus would have no concern for insecurity when attaching and using current art. No leaning forward would be necessary for occupant.

(g) A preformed clip for holding shopping list of occupant would keep same in view when using current art.

(h) Preformed pocket on outside trailing face of folding side would assure occupant of whereabouts of contents (checkbook. etc.).

(i) Current art will be inexpensive to manufacture and will be maintenance free. Materials used would be user friendly—not easily damaged. Purchase price of product would be attractive to consumer and insurance concerns would be minimal.

Still further objects and advantages will become apparent from the following descriptions and drawings.

DESCRIPTION OF THE PREFERRED EMBODIMENT

Figure 1:
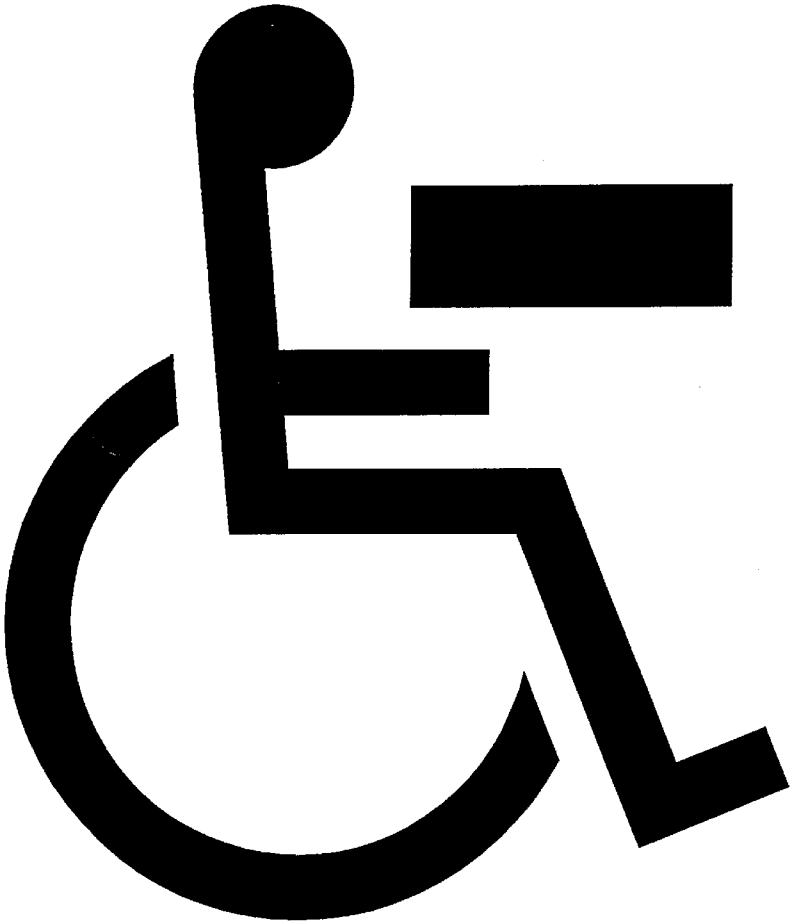
FIG. 1 is a conceptual drawing of adjustable shopping baskets for wheelchairs with armrests when viewed from the side as it would appear when in place on the wheelchair and ready to be utilized for conveying items of need from one place to another.

A conceptual diagram of the invention is depicted in FIG. 1 reflecting a concept of a logo for marketing purposes.

Figure 2:
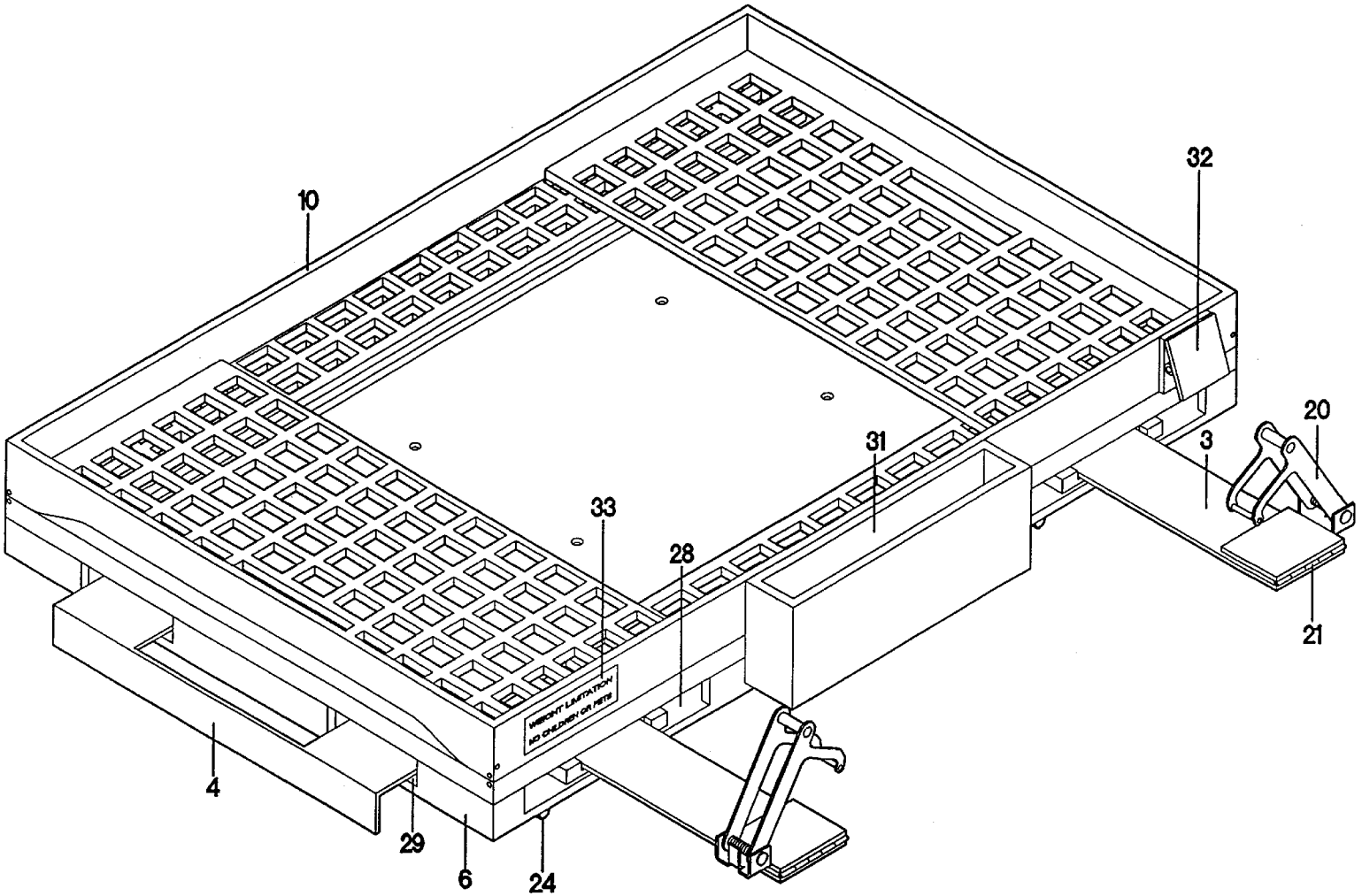
FIG. 2 is a perspective view of adjustable shopping basket as it appears in collapsed state prior to use.

FIG. 2 is a perspective view of the adjustable shopping basket 10 for wheelchairs with armrests as it appears prior to use. The overall dimensions of the invention of the preferred embodiment are 24" wide×16" deep×9" high while the basket is in an open, upright position.

In FIG. 2 a preferred embodiment of the invention is shown with the sides collapsed as appearing when viewed from above, before being placed into use on the wheelchair. The basket is designed for use with various sized manual wheelchairs with armrests. Therefore, discussion of component parts and their use is to be considered as a mirror image (duplicated on each armrest).

Figure 7:
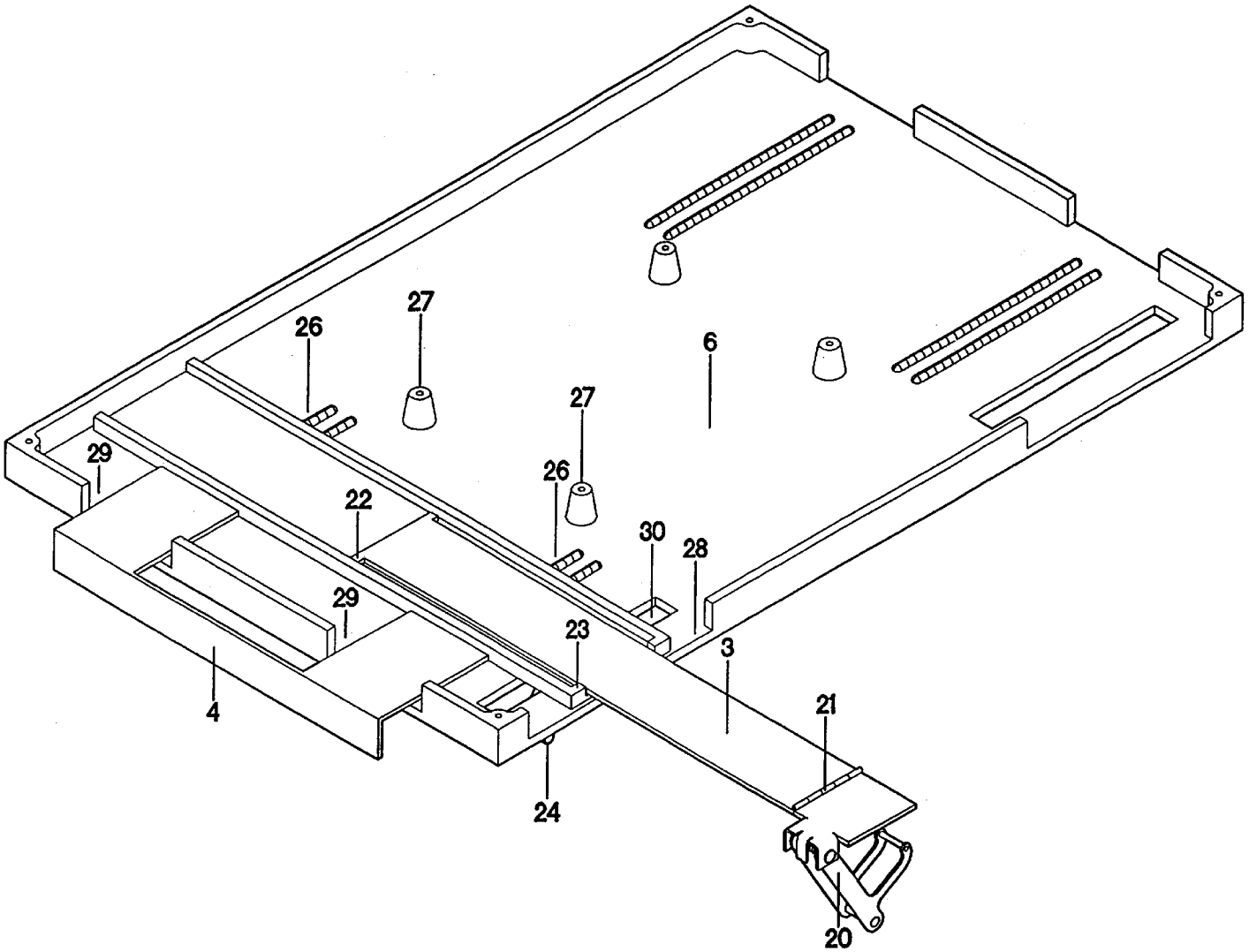
FIG. 7 is a perspective view of the base, as seen from above, which provides for self-contained components which makes adjustments for width possible and also supports the collapsible basket.

Every part of the adjustable shopping basket is in some way attached to (or originates from) the base assembly 6. As shown in FIG. 7, the base assembly 6 houses a variety of components. The smooth bottom of the collapsible basket 10, is anchored by flathead screws to islands 27, forming a ceiling of the base assembly, FIGS. 7 & 8, thus completing a six sided rectangular base housing. The dimensions of a preferred base housing are 24" wide×16" deep×1" thick.

The handle assembly 4 enables the basket to be compatible with all widths of manually operated wheelchairs with armrests. The sliding handle assembly 4 has a rectangular, flat member with raised outer edges. Stops 23 at the front end of the edges restrict forward movement of the handle assembly. A handle portion of the handle assembly 4 projects from the flat member through openings 29 in the side of the base 6. This may be used as a grasping point to enable the handle assembly 4 to be moved from side to side.

Figure 5:
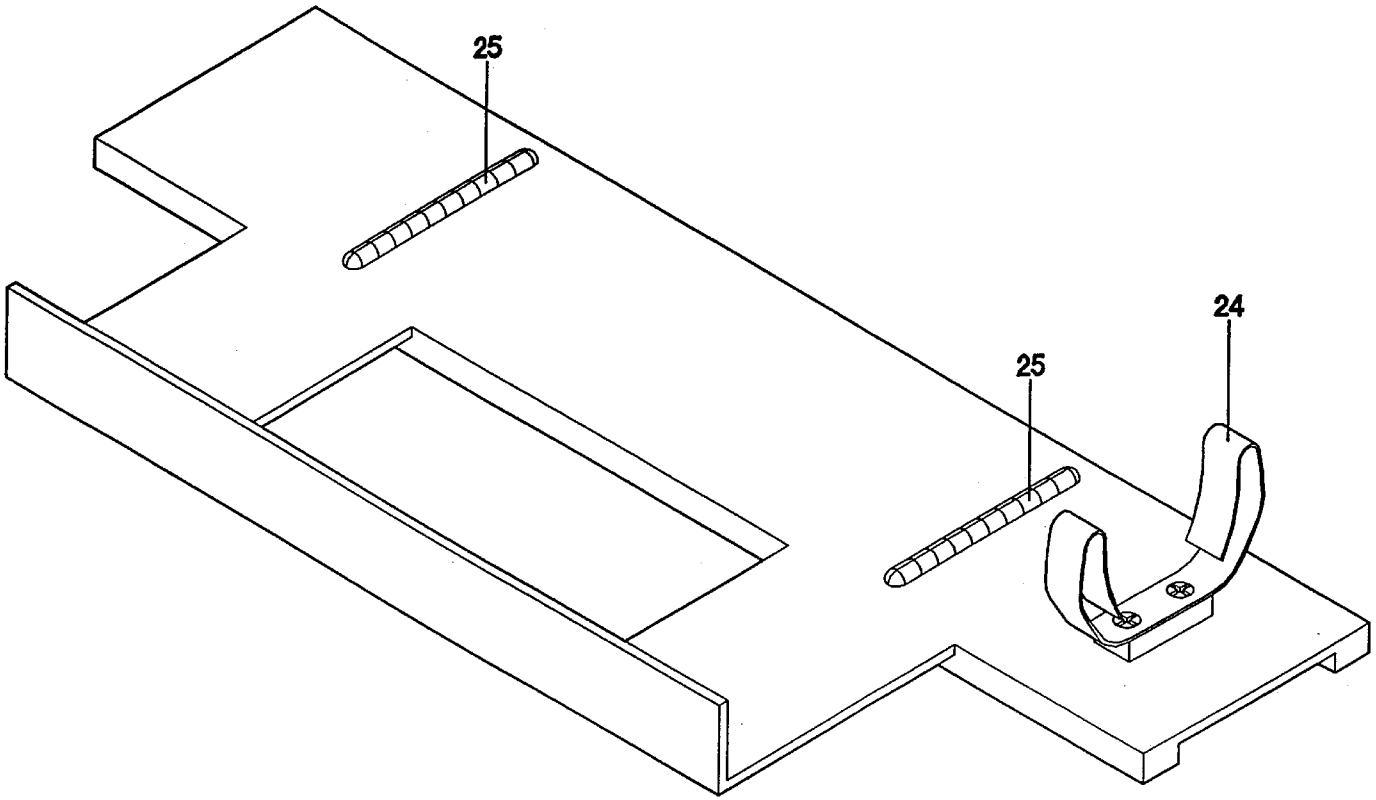
FIG. 5 is perspective drawing of underside of sliding handle assembly which indicates placement of "C" clamp and tracks which guide the sliding handle assembly.
Figure 6:
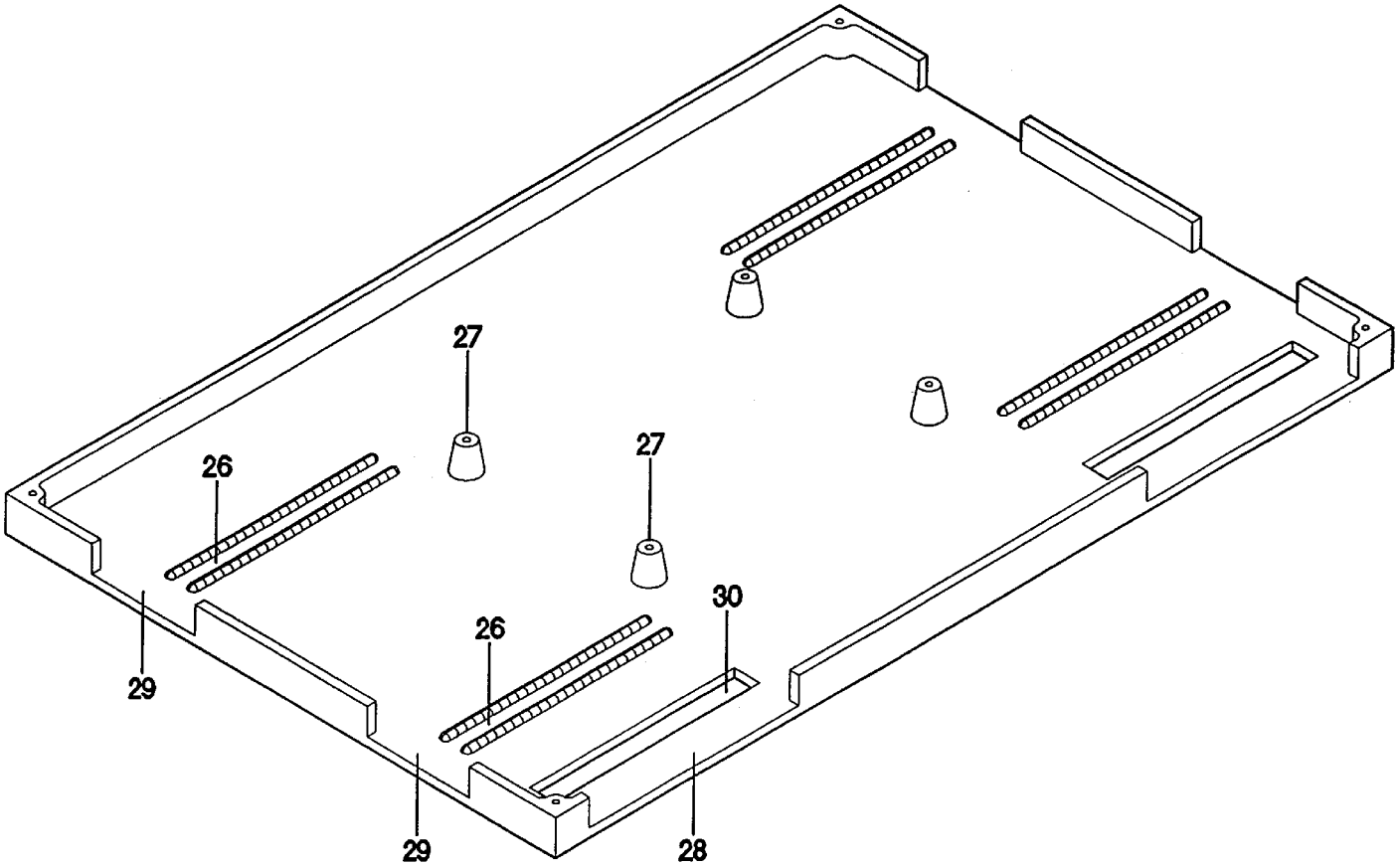
FIG. 6 is an interior view of the floor of the base as viewed form above, clearly depicting provisions for components of the sliding handle assembly and connecting points for the collapsible basket which will form the ceiling of the base when connected thereto.

The view of the base 6 in FIG. 6 reveals preformed guide channels 26. Along with corresponding preformed protrusions 25 on the underside of sliding handle assembly 4, as seen in FIG. 5, the channels create a tongue and groove arrangement and guide smooth, horizontal movement of the sliding handle assembly 4 through preformed cut out openings 29 (from right to left/left to right) when grasped by the wheelchair occupant.

Figure 4:
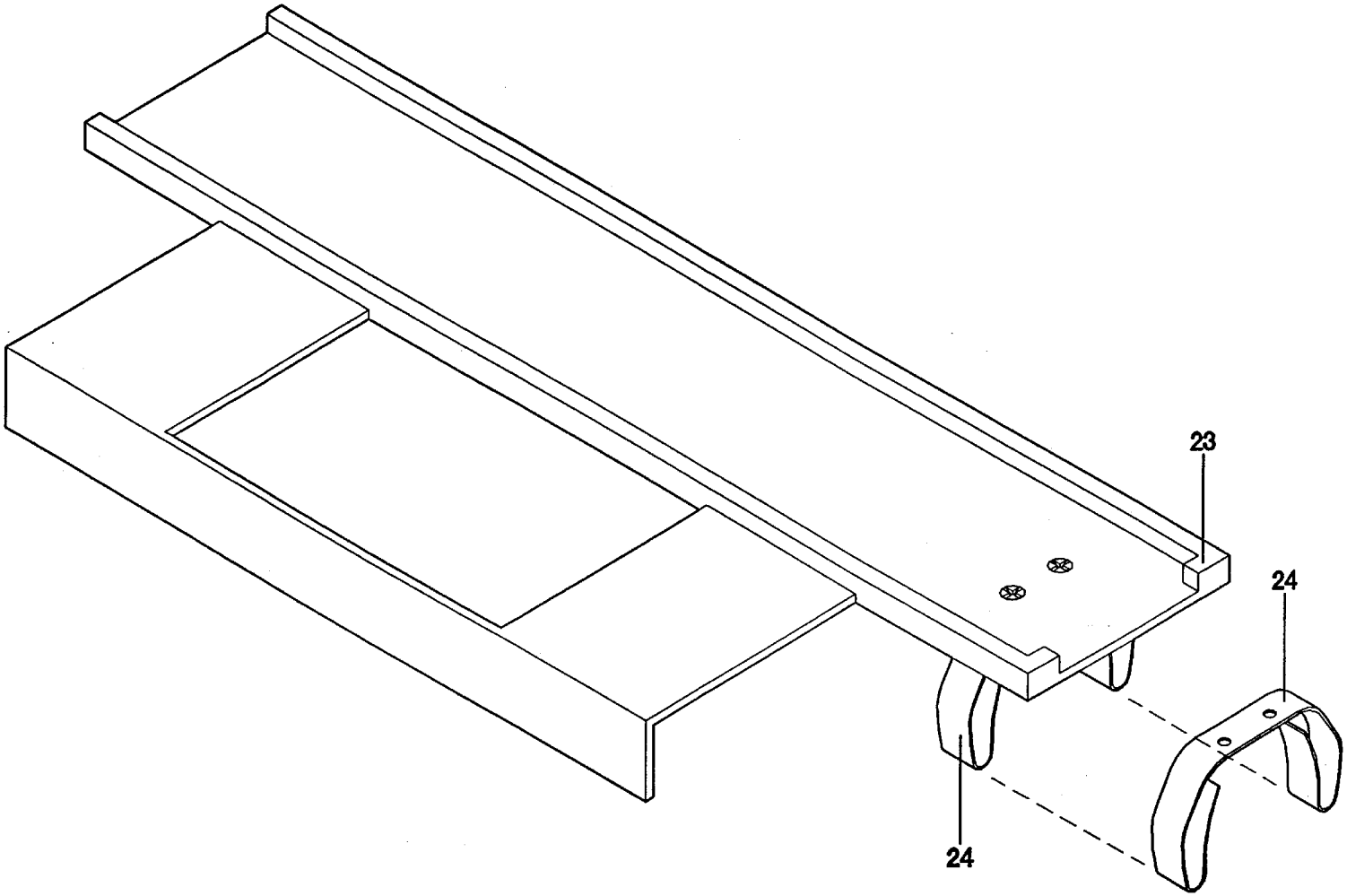
FIG. 4 is a perspective view of the sliding handle assembly which permits adjustment for distance between armrests; same carries support bar mentioned above as well as "C" clamp which connects to underside of sliding handle assembly.

The sliding handle assembly, as viewed from above in FIG. 4, reveals a c-clamp 24 attached to the under-side of the handle 4. Clamp 24 is a commercially available c-clamp and is attached to the underside of the sliding handle assembly 4 by well two known fasteners such a flathead screws. The c-clamps extend through slot 30 in the floor of the base 6 so that, in use, the c-clamp attaches to a forward part of the armrest.

Handle assembly 4 is a key element of the invention because it is the moving member which conveys metal support bar 3. Support bar 3 culminates with spring-loaded clamp 20 which is attached thereto by a spring laded hinge 21. Sliding handle assembly 4 (including metal support bar 3 with hinged spring loaded clamp 20, as well as c-clamp 24 located on the underside of the sliding handle assemble 4) moves as one unit from within base 6. It should be noted that prior to attaching the collapsed adjustable shopping basket 10 to the armrests of a wheelchair, spring-loaded clamp 20 is in an upright vertical position as seen in FIG. 2. The hinge 21 is necessary to prevent possible damage to the wheelchair armrests as the support bar and clamp are being drawn along the top length of the armrest before being attached to the armrest.

Figure 3:
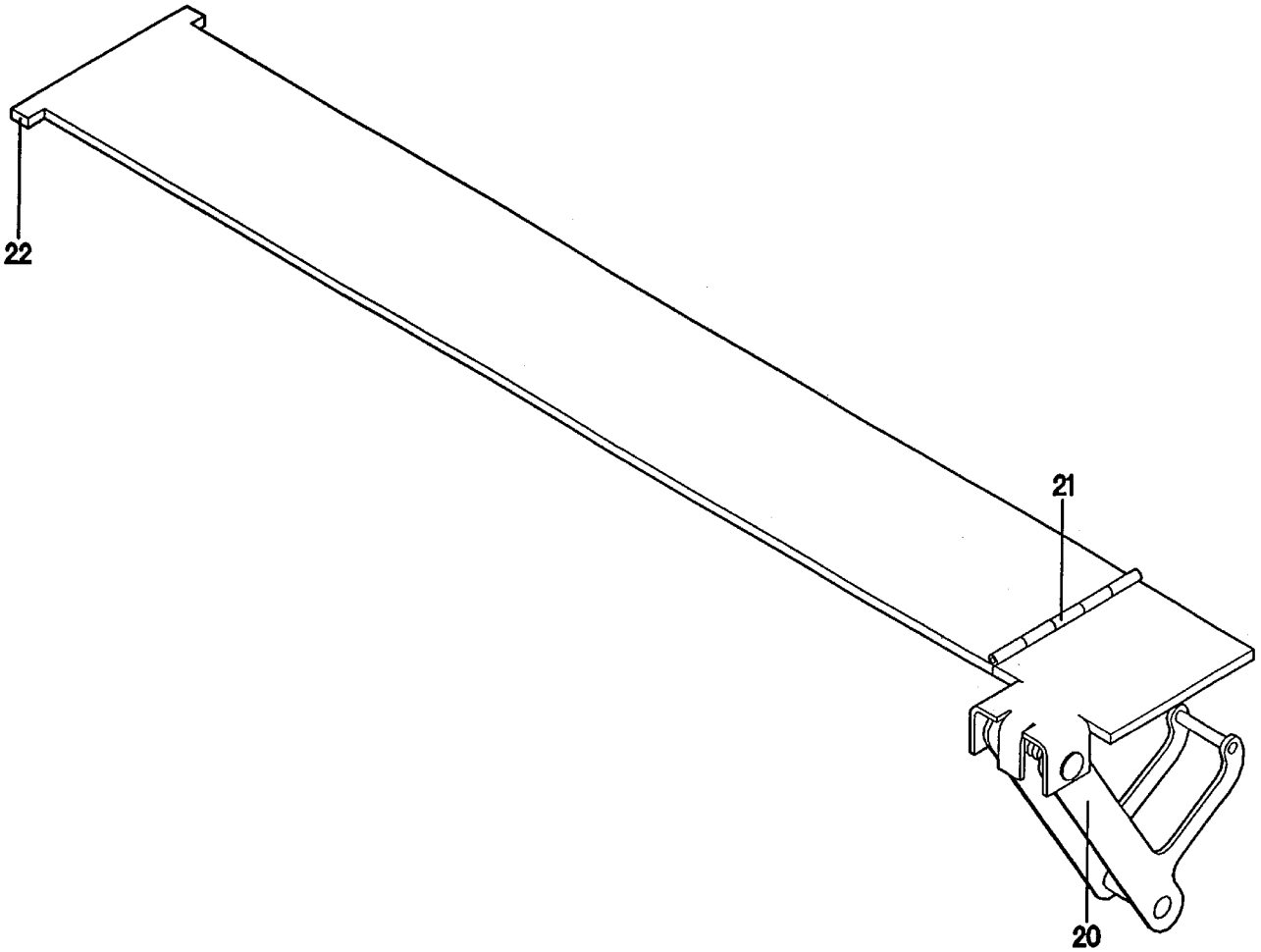
FIG. 3 is perspective drawing of metal support bar which culminates in a spring loaded clamp which connects to armrest.

The support bar 3, as shown in FIG. 3, comprises a hinge 21, permitting the spring loaded clamp 20 to rotate from the upright vertical position to a lower position onto an appropriate area of the armrest of the wheelchair. Appropriate connecting locations on the armrests will be determined by the wheelchair user according to the personal size of the user. The protrusions 22 of the support bar 3 are designed to prevent the support bar 3 from being totally released from the sliding handle assembly 4. The support bar 3 moves in a direction perpendicular to the motion of the handle assembly and extends out of the base 6 through exit ports 28.

The base 6 and the sliding handle assembly 4 are made of a molded synthetic material. Support bars 3, commercially available c-clamps 24, hinges 21, spring-loaded clamps 20 and all screws are metal. Metal is preferred and necessary as support bar 3, with clamps 20 and 24, in place on the armrest of the wheelchair, provide support and balance of the basket and contents therein as the invention spans the distance between the armrests of the wheelchair.

Figure 8:
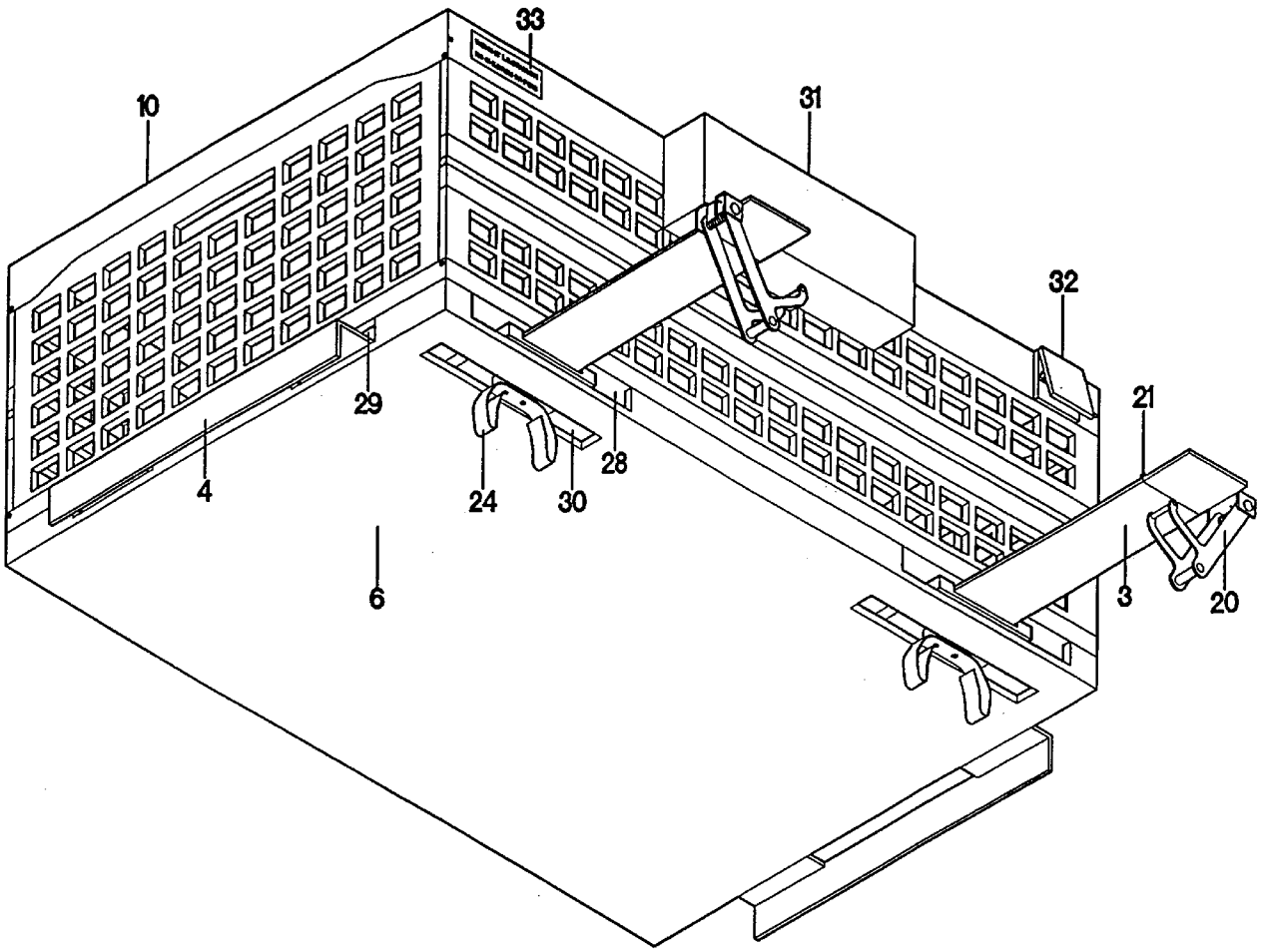
FIG. 8 is an underside view of the base which reflects placement of "C" clamp which moves within the base when sliding handle assembly is moved in placing/mounting adjustable shopping basket to wheelchair.
Figure 9:
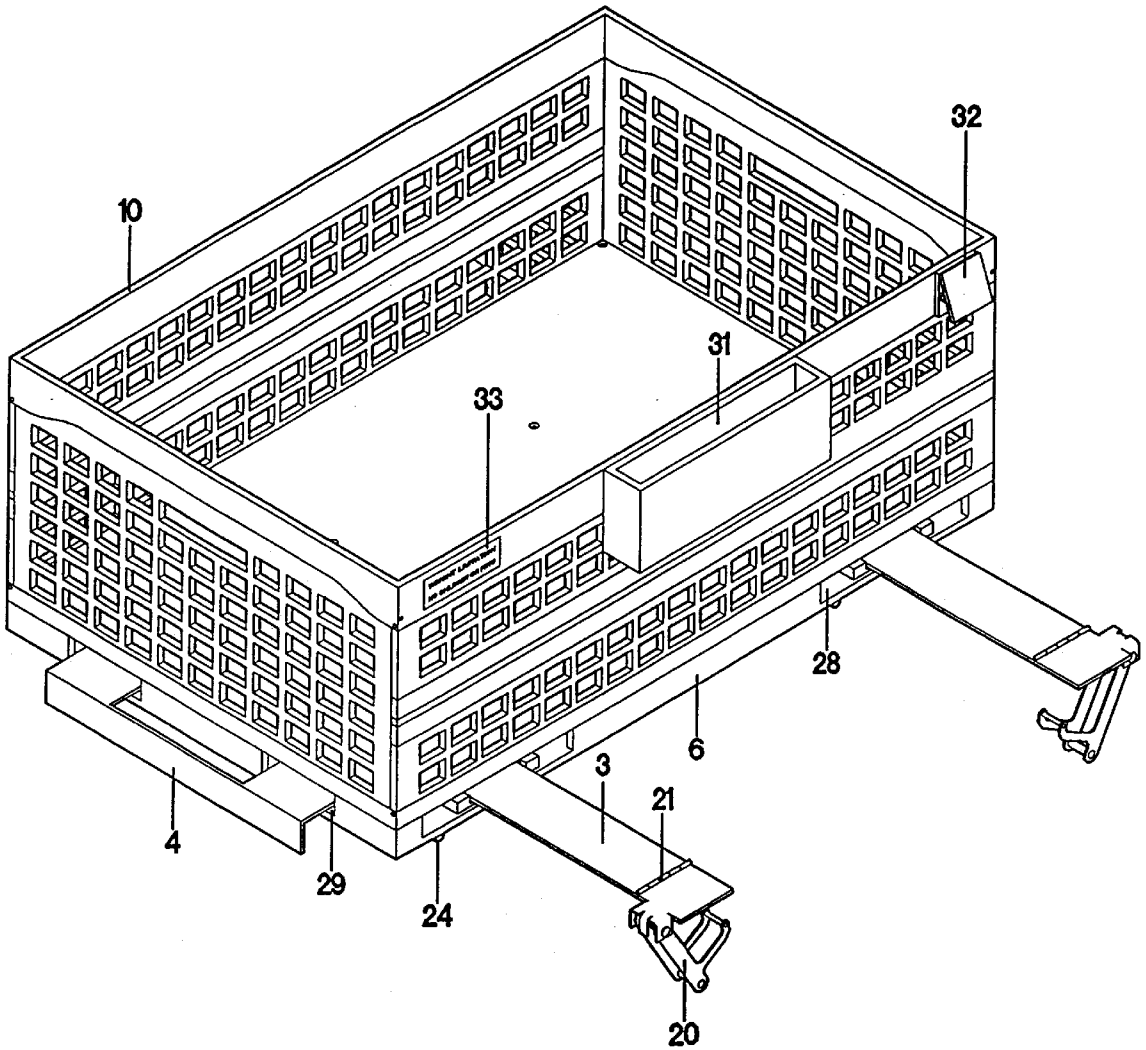
FIG. 9 is perspective view from above of collapsible basket, fully assembled in upright position revealing support bar and sliding handle assembly.

Added features visible in FIGS. 8 and 9 include a prestamped printed safety message 33, a pocket 31 designed to hold perhaps, a checkbook and/or a pocket calculator, etc. and a clip 32 for holding a shopping list. These features are located on the rear side nearest the user for convenience, visibility and security of personal effects.

The commercially available basket is of collapsible design, with sides being horizontally folded and ends which swing down, locking the sides in place. Each side consists of two sections with interlocking cutouts, permitting said sections to fold horizontally, thus stacking one section on top of the other when collapsed. The basket's sides could be suitably made of strong netting, wire mesh, or fabric, supported with rigid synthetic, connected to solid, synthetic material bottom. Same would still be collapsible and permit better visibility, less weight and ease of handling for the disabled user. Predetermined synthetics are the desirable medium for molding considerations, cost effectiveness, strength, durability, weight, safety and eye appeal, all making for an easy, autonomous application of invention.

OPERATION

Adjustable shopping basket for wheelchairs will be positioned as shown in FIG. 1. FIG. 2 shows basket in "collapsed" position; also indicates front elevation showing visible primary components including: support clamp 20, support bar—FIG. 3, sliding handle assembly—FIG. 4 where underside clamp 24 is mounted.

Sliding handle assembly—FIG. 4 adjusts support bar—FIG. 3 and underside clamp 24 in one single motion (per side). (Adjustments made possible by sliding handle assembly—FIG. 4 are to facilitate differing dimensions of wheelchair armrests.) Grasping sliding handle assembly—FIG. 4 pull outward, perpendicular to armrest of wheelchair, to position support bar—FIG. 3 and underside clamp 24 simultaneously, directly over wheelchair armrest. A firm downward thrust will attach underside clamp 24 to forward end of armrest.

Before and during withdrawal of support bar—FIG. 3—from base—FIG. 7—hinged portion of support bar should remain in upright vertical position. Support bar—FIG. 3 can now be withdrawn and pulled to opposite end of wheelchair armrest—move hinged portion of support bar—FIG. 3 to a horizontal position to enable spring-loaded clamp 20 to secure said clamp to the underside of wheelchair armrest. This is done by pulling end of clamp outward and allowing spring to contract to original form, thereby gripping wheelchair armrest. (To prevent removal and/or loss of support bar—FIG. 3, the forward end of bar is designed with protrusions 22—⅛"×⅛" extending from either edge of support bar.)

After the adjustable shopping basket for wheelchairs has been connected/secured to both armrests, basket which is still in collapsed form—FIG. 2, is now ready to be put into final/open assembled position—FIG. 9. Slipping both hands into slots located on outer ends of basket, an upper pull will straighten "folded" sides and enable hinged ends to close into vertical position thus holding/locking heretofore "folded" sides in upright/open form and locking all sides into a basket enclosure. Adjustable shopping basket for wheelchairs—FIG. 9—is now ready for use to shopper's advantage as wheelchair is being manually operated.

SUMMARY, RAMIFICATIONS AND SCOPE

Accordingly, the reader will see that my shopping basket is superior to the prior art because it is adjustable to fit a variety of sizes of wheelchairs; it is lightweight, enabling the wheelchair user to handle and utilize same independently; it can be transported and/or stored easily because it is lightweight and collapsible; this basket will enable the user to utilize same while remaining in the manually operated chair instead of changing to a "store provided" power driven chair; integral pocket and clip will free up the users hands for chair operation and activities engaged in with the use of the basket; it will easily be identifiable due to the business logo of the business providing the basket to the user (screenprinted on external and/or internal faces of basket per desires of provider); having four points of connection to wheelchair armrests, basket attaches and/or removes easily; when in place on the wheelchair—sufficient space is provided for carrying/transporting many items without concern for being displaced/misplaced or dropped and without concern for becoming unstable; sufficient visibility is provided to the user for safety consideration because basket is of open grid design.

Although the description above contains many specificities, these should not be construed as limiting the scope of my invention but as merely providing illustrations of some of the presently preferred embodiments of this invention. For example, shopping basket's "folding sides" could be manufactured from fabric mesh or wire grid for increasing maximum visibility and decreasing overall weight. Support bar is made of steel and balance of product could be produced of fiberglass, aluminum, plastic or carbon fiber.

Possible uses include but are not limited to: disabled person making trips to college campus, swimming pool, grocery store, malls and a variety of other shopping places, laundromat, libraries . . . ANYWHERE that a portable container is preferable to just your lap; if adjustable shopping basket is sold directly to the end user, a canvas carrying case is designed for enclosing same and making possible, attaching to back of wheelchair when basket is being transported to and/or from above listed (but not limited to) locations.

As various modifications could be made in the constructions herein described and illustrated without departing from the scope of the invention, it is intended that all matter contained in the foregoing description or shown in the accompanying formal drawings shall be interpreted as illustrative rather than limiting.

It is claimed:

1. An adjustable shopping basket adapted for use on wheelchairs with armrests, said basket comprising;

a collapsible container having a front, a rear and two sides; panels on the front and sides are collapsible to a horizontal state for storage or transport, and arranged vertically when in use, and a base housing including support and adjustment means, the support and adjustment means comprising a pair of sliding handle assemblies located in the base housing, each said sliding handle assembly being independently, linearly movable in a side to side direction, each said sliding handle assembly comprising a c-clamp extending through a slot in the base housing, said c-clamps adapted to attach to armrests of a wheelchair, the support and adjustment means further comprising an elongated support bar slidably attached to each of the sliding handle assemblies, said support bars linearly movable in a front-to-rear direction, an end of each support bar at the rear of the basket hingedly supporting a spring-loaded clamp adapted to attach to an armrest of a wheelchair, whereby the support and adjustment means allows side to side and front to back adjustment of the placement of the basket on a wheelchair, and the spring-loaded clamps and c-clamps allow secure attachment to the armrests.

* * * * *